US007081026B2

(12) United States Patent
Schwarz

(10) Patent No.: US 7,081,026 B2
(45) Date of Patent: Jul. 25, 2006

(54) ELECTRICAL DEVICE CONNECTING A LINE TO AN ELECTRODE

(75) Inventor: Dieter Schwarz, Neubulach (DE)

(73) Assignee: Nicolay Verwaltungs-GmbH, Nagold (DE)

( * ) Notice: Subject to any disclaimer, the term of this patent is extended or adjusted under 35 U.S.C. 154(b) by 0 days.

(21) Appl. No.: 10/815,948

(22) Filed: Apr. 2, 2004

(65) Prior Publication Data

US 2004/0203273 A1 Oct. 14, 2004

(30) Foreign Application Priority Data

Apr. 9, 2003 (DE) ..... 103 17 286

(51) Int. Cl.
*H01R 4/48* (2006.01)

(52) U.S. Cl. ..... 439/729; 439/859; 439/909

(58) Field of Classification Search ..... 439/266, 439/310, 725, 909 X, 268, 729, 816, 819, 439/822, 859, 909
See application file for complete search history.

(56) References Cited

U.S. PATENT DOCUMENTS

| | | | | |
|---|---|---|---|---|
| 3,850,493 | A * | 11/1974 | Clewes et al. | 439/269.1 |
| 4,165,141 | A * | 8/1979 | Williams et al. | 439/342 |
| 4,468,073 | A * | 8/1984 | Machcinski | 439/266 |
| 4,842,557 | A | 6/1989 | Muz | |
| 5,037,315 | A * | 8/1991 | Collier et al. | 439/83 |
| 5,454,739 | A * | 10/1995 | Strand | 439/729 |
| 5,961,344 | A | 10/1999 | Rosales et al. | |
| 6,487,430 | B1 * | 11/2002 | Henderson et al. | 600/394 |
| 6,780,065 | B1 * | 8/2004 | Schwarz | 439/725 |
| 2003/0228805 | A1 * | 12/2003 | Schwarz | 439/725 |
| 2004/0203273 | A1 * | 10/2004 | Schwarz | 439/266 |

FOREIGN PATENT DOCUMENTS

| | | | |
|---|---|---|---|
| DE | 3527916 | A1 | 2/1987 |
| DE | 3719474 | A1 | 12/1988 |
| DE | 4009938 | C2 | 10/1991 |
| DE | 19801173 | C1 | 7/1999 |
| DE | 103 17 286.6 | | 4/2003 |
| EP | 0 268 364 | A2 | 5/1988 |
| EP | 0325573 | A2 * | 7/1989 |
| GB | 2 179 506 | A | 3/1987 |

* cited by examiner

*Primary Examiner*—James R. Harvey
(74) *Attorney, Agent, or Firm*—Roylance, Abrams, Berdo & Goodman, L.L.P.

(57) ABSTRACT

A device (1) electrically connects a connecting line (2) to an electrode (44), in particular a medical engineering skin electrode, with a contact member (3) for plug connection to a contact pin (43) of the electrode (44). The contact member (3) has an energy storing element (4) for spring biasing of the contact member (3) into contact with the contact pin (43) of the electrode (44). The device (1) has at least one actuating element (8,9) mounted to be deflected such that the contact member (3) may be actuated to an open position.

20 Claims, 4 Drawing Sheets

ELECTRICAL DEVICE CONNECTING A LINE TO AN ELECTRODE

FIELD OF THE INVENTION

The present invention relates to a device for electrical connection of a connecting line to an electrode, in particular a medical engineering skin electrode.

BACKGROUND OF THE INVENTION

Devices for electrical connection of a connecting line to an electrode, in particular a medical engineering skin electrode, are disclosed in DE 37 19 474 A1. Such connecting devices are used, for example, for measurement of physiological signals from living beings, such as heart action voltages (electrocardiogram, EKG). The electrodes are positioned on the patient's skin, by an adhesive, for example, and are connected to an electric connecting line over which the physiological electrical signals are conducted to an evaluating device. The disclosed connecting device operates as a snap fastener connection and is snapped onto the contact pin of the electrode. The contact pin may be a separate element of the conventional electrode or may, for example, form the electrode surface itself in conjunction with a lower side of a plate-shaped base component.

The user places heavy demands of such devices. Thus, making and breaking the connection should be permitted without application of great force, while at the same time producing a durable electric connection of high quality. An obstacle to meeting these requirements is presented by the electrodes being generally mass-produced and being made for one-time use. For these reasons, the connecting heads of the electrodes present only low dimensional accuracy and high tolerances. In addition, the electrode dimensions vary from manufacturer to manufacturer.

Consequently, electrode clamps have been developed as an alternative to the generic devices disclosed. Operating legs are opened against the force of a spring and are mounted on the head of the electrode, electrical contact being established when the electrode clamps are released. The retaining force can be set very effectively by the spring used. As a rule, no problem is encountered in release of the electrode clamps. However, such electrode clamps present the disadvantage that, because of the structural configuration of the operating legs, the contact member has an external shape with multiple surfaces unsuitable for wearing under clothing.

SUMMARY OF THE INVENTION

Objects of the present invention are to provide a widely usable device which eliminates the disadvantages of conventional devices and which may be connected to the electrode and disconnected from the electrode with low application of force but nevertheless has high retaining strength. By preference the device is also to be suitable for wearing under clothing. In addition, the conventional insulation requirements set for medical engineering applications are to be satisfied.

The foregoing objects are basically obtained by a device for electrical connection of a connecting line to an electrode, particularly a medical engineering electrode, with a contact member for plug connection to a contact pin of the electrode. The contact member has an energy storing element establishing spring-biased contact of a contact zone of the contact member to the contact pin of the electrode. The device has at least one actuating element displaceably mounted such that the energy storing element may be deflected when it is displaced. The contact zone of the contact member is thereby operated so as to effect opening.

The contact member, preferably, is designed to be more or less two-dimensional. The opening movement of the contact member preferably is accomplished by deflection or displacement of the contact member, more or less parallel to the surface formed by the contact member. In particular, deflection of the energy storing element and accordingly storage of energy take place when the actuating element is displaced. As a result of the opening actuation of the contact zone of the contact member, the contact pin may be introduced into the device with almost no expenditure of energy. During the subsequent resetting of the actuating element, the contact zone is brought by the stored energy into electrically conductive contact on the contact pin of the electrode. A long lasting engagement of the contact member ensuring reliable contact which subjects the contact zones to less mechanical stress is thereby obtained. High opening forces may be applied without a problem as a result of the biased operation of the actuating element. As a result, high retaining forces, and thus high contact forces, may also be provided, while the device may be easily applied to the electrode and separated from it.

The contact member preferably has two contact zones for the contact pin positioned symmetrically relative to the axis of introduction of the device. These contact zones are designed to be more or less folded by bending of a contact tongue or to be two-dimensional. The legs of the spring forming the energy storing element, preferably in the form of strips, are bent at an angle to the surface of the contact tongues, in particular at a right angle. The entire contact member preferably is designed to be integral as a stamped/bent component.

The translatory movement of the actuating element preferably is reoriented by the device of the present invention to rotary movement of the drive element. For this purpose, the actuating element is eccentrically coupled to the drive element mounted rotatably in the housing of the device. The drive element and that actuating element preferably are coupled eccentrically to each other by a pin introduced into a slot.

Also preferably, the rotary movement of the drive element is converted to translatory movement by which the contact member is actuated to effect opening. For this purpose, the drive element may have, for example, a contact surface extending eccentrically, by means of which the contact member is actuated. The eccentrically extending contact surface preferably is in contact with the contact member, in particular with the energy storing element of the contact element. For example, the drive element may have a journal in one piece or several pieces projecting from the base plate. The surface of the journal, a rounded surface, for example, is flattened or blocked in at least one place. By the flattening or blocking, the journal may come in contact with the contact element during rotation and deflect it as required.

To prevent straining of the energy storage of the contact element, the movement of the actuating element is limited. For this purpose, the drive element and the actuating element preferably have interacting stopping means which limit displacement of the actuating element. Optionally or in addition, the actuating element and the housing of the device also may have stopping means.

In one particular embodiment of the present invention, two actuating elements are mounted on opposite sides of the device. Consequently, application of high forces may be combined with simplicity of handling, for example, through actuation of the two actuating elements by the thumb and index finger of one hand. The two actuating elements preferably are coupled with a common drive element.

In one particular embodiment, the device has a rounded shape as seen in a top view. For example, the outline may, in particular when the device is connected to the electrode, be more or less circular in shape with the radially outwardly extending connecting line as seen in a top view. The outline may also be rounded as seen in a side view. In particular, the device may have a cylindrical basic shape, with a rounded edge between cover surface and jacket.

In one particular embodiment of the present invention, the housing has, on the surface facing the electrode with which contact is to be established, an elastoplastic deformable wall. The hardness of such wall is lower than that of another wall of the housing, preferably lower than that of the other housing shell. The deformable wall preferably is made of a thermoplastic elastomer. As a result of the soft elastic deformability, this wall guarantees snug fitting of the device on the electrode with which contact is to be made. Consequently, the contact reliability is increased. The comfort of wearing such devices is improved as well.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
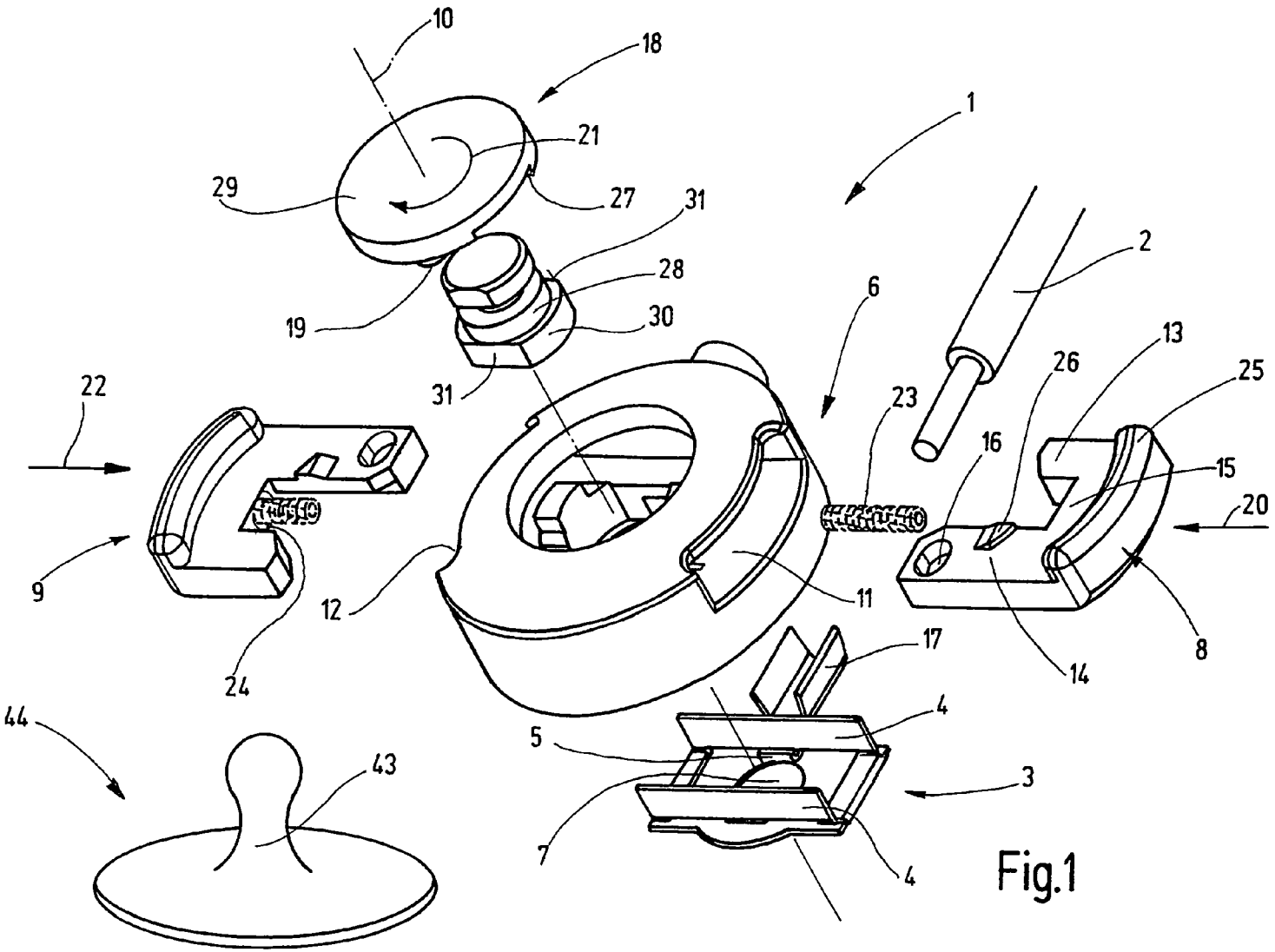
FIG. 1 is an exploded, top perspective view of individual components of a device according to the present invention.

FIG. 1 illustrates the individual elements of a device 1, in an exploded view. The device 1 for electric connection of a connecting line 2 to an electrode 44, has a contact member 3 for plug connection to a contact pin 43 of the electrode 44. The structure of the contact member 3 is substantially similar that disclosed in DE 37 19 474 A1 or U.S. patent application Ser. No. 10/444,949 (now U.S. Pat. No. 6,780,065), the subject matter of which is thereby incorporated by reference. In particular, the contact member has two energy storing elements 4 in the form of spring legs extending parallel to each other when not extended. The spring legs form a one-piece contact bead 5 in their central area. With the bead end spaced a certain distance from the energy storing element 4, the contact beads 5 form a contact zone which, in a side view, is curved or wedge-shaped, and in a top view is straight, wedge-shaped, or curved. The contact zone extends into an opening for the contact pin 43 of the electrode 44 with which contact is to be established. The energy storing elements 4 are fastened on the more or less flat contact member 3 near their ends on the longitudinal sides.

The housing body 6 is substantially circular in the top view, preferably is substantially cylindrical, and has, diametrically opposite its longitudinal axis 10, openings 11 and 12. Each opening receives an actuating element 8, 9. Both actuating elements 8, 9 are identical in shape as equal parts. Thus, only one actuating element 8 is to be described in detail.

As seen in the top view, the actuating element 8 is U-shaped with two legs 13, 14 of different lengths. The connecting section 15 connecting the legs 13, 14 replicates the outline of the housing body 6 as seen in the top view and has a raised edge 25. The longer leg 14 has, on its end opposite the connecting section 15, a slot 16 into which is introduced a pin 19, preferably integral with the drive element 18. When the actuating element 8 is actuated in the direction of the arrow 20, the drive element 18 is set in rotation in the direction of the arrow 21 as a result of the eccentric mounting of the pin 19 relative to the axis of rotation of the drive element 18, which axis coincides with the longitudinal axis 10 of the housing body 6. In addition, a corresponding situation arises in the case of movement of the other actuating element 9 in the direction of the arrow 22. Both actuating elements 8, 9 preferably are actuated at the same time.

Actuation takes place against the action of the helical spring 23, one end of which is seated in a boring or bore 24 in the connecting section 15 and the other end of which rests against the housing body 6. The actuating element 8 forms, on the longer leg 14, a first stopping means 26 in the form of a catch. When the actuating element is introduced into the housing body 6, stopping means 26 comes into contact with a second stopping means 27 on drive element 18, and thereby, prevents further introduction of the actuating element 8 into the housing body 6.

The drive element 18 also comprises a drive journal 28, the longitudinal axis of rotation 10 of which is oriented toward the opening 7 of the contact member 3. In the exemplary embodiment illustrated, the drive element 18 is configured in two pieces. The drive journal 28 in particular is connected by positive locking by insertion into the drive cover 29, and is non-rotatably connected to the drive cover. While the drive cover 29 is of a plastic, the drive journal 28 is of metal. Similarly, the drive cover 29 and the drive journal 28 may be configured to be of one piece, in particular one of plastic. If necessary, they could both be of metal.

On its end opposite the drive cover 29, the drive journal 28 has a cylindrical jacket or other surface 30 having flattened areas 31 on two opposite sides. In the initial situation illustrated, the width of the drive journal 28 between the two flattened areas 31 corresponds substantially to the spacing of the two energy storing elements 4 of the contact member 3. When the drive element 18 is rotated in the direction indicated by the arrow 21, however, the jacket or outer surface 30, which, for example, is partly cylindrical, comes to rest against or engages the energy storing elements 4, and moves those elements apart so that the contact beads 5 clear the opening 7 for entry of the contact pin 43.

Figure 2:
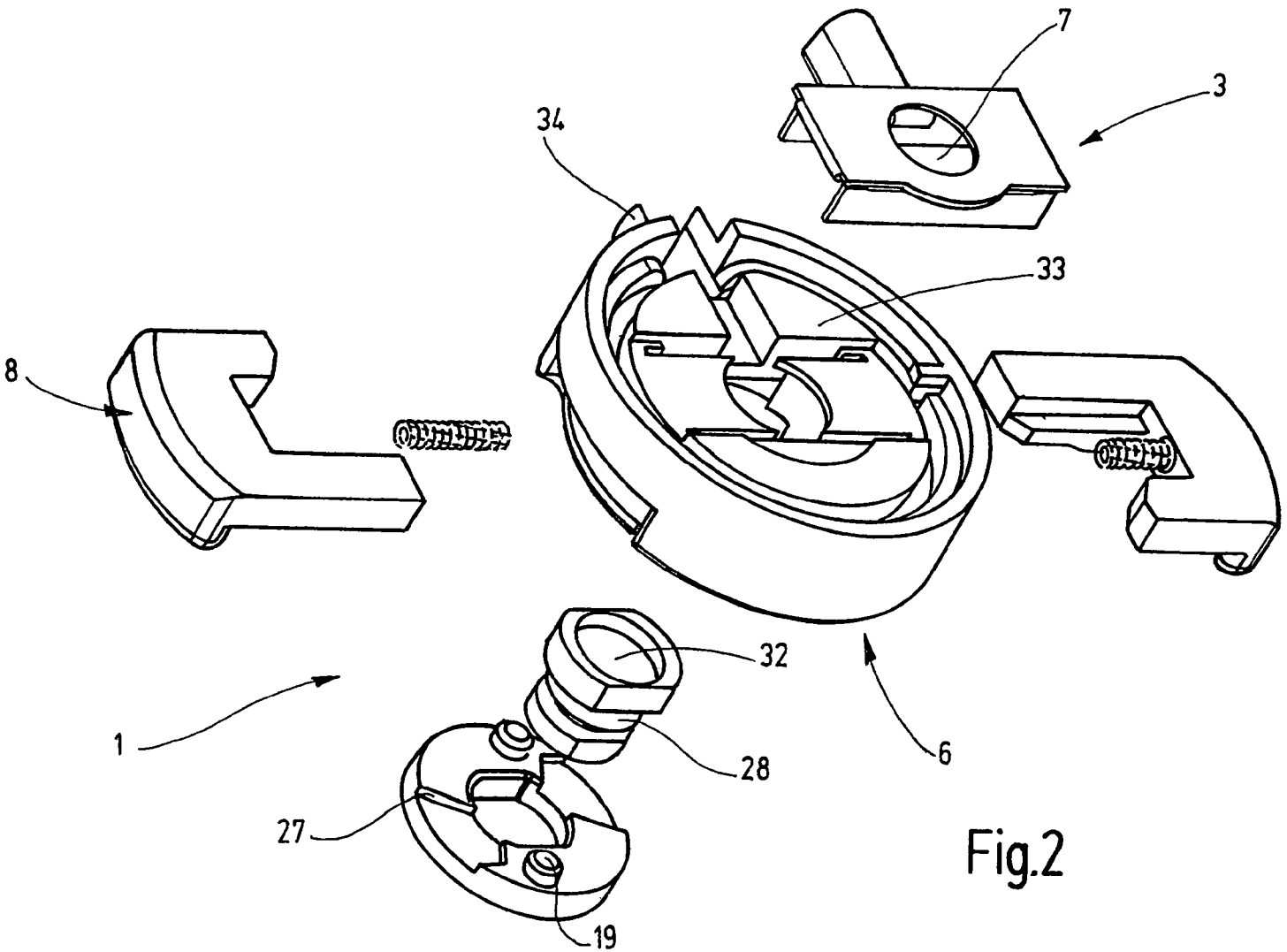
FIG. 2 is an exploded, bottom perspective view of the device in FIG. 1.

FIG. 2 illustrates the configuration of the device 1 of FIG. 1 as seen from the lower side. On its frontal surface facing the contact member, the drive journal 28 has an insertion opening 32 for the contact pin 43. The width of the insertion opening 32 corresponds more or less to that of the opening 7 in the contact member 3. The housing body 6 has, on its lower side shown in FIG. 2, a positive-locking recess 33 for the contact member 3. Consequently, the contact member is fastened exclusively by positive-locking insertion into the housing body 6. In addition, the housing body 6 forms an integral support 34, radially projecting and partly circular in cross-section, for the connecting line 2.

The device claimed for the invention preferably is produced in the following steps.

Figure 3:
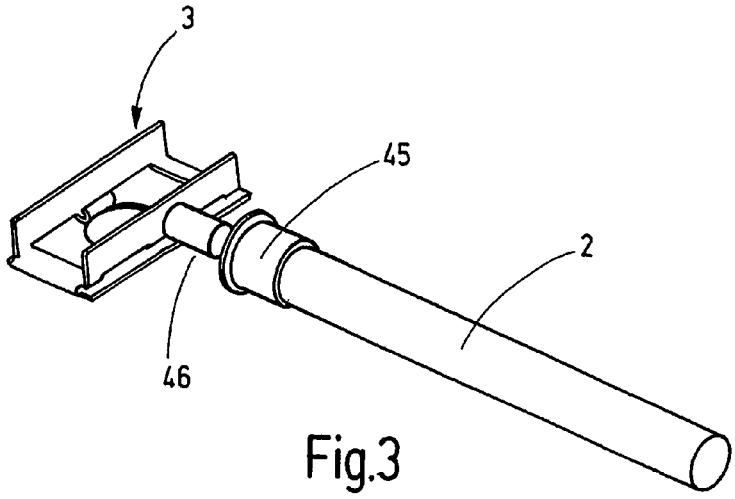
FIG. 3 is a perspective view of the connection of the contact member to the connecting line of the device of FIG. 1.

First the connecting line 2 is electrically connected to the contact member 3, preferably by means of a crimped connection 46. In addition, a strain relief sleeve 45 is mounted on the connecting line 2. The situation thus reached is shown in FIG. 3.

Figure 4:
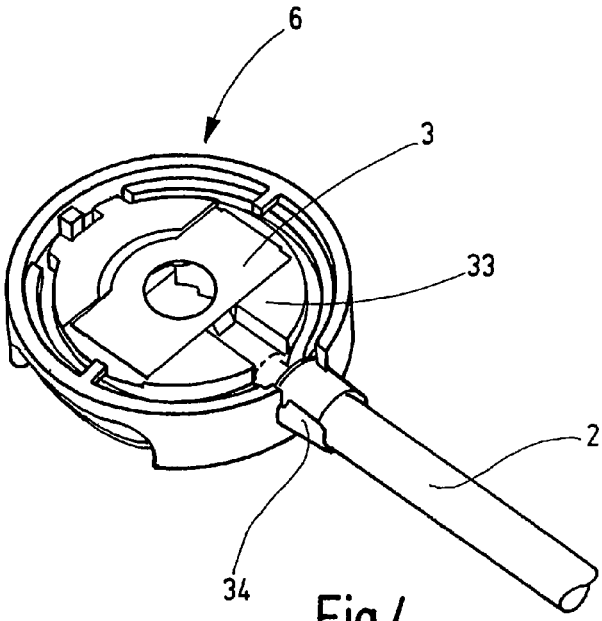
FIG. 4 is a perspective view of the introduction of the contact member into the body of the housing of the device of FIG. 1.

The connecting line 2 with the contact member 3 is introduced from the lower side into the recess 33 in the housing body 6 and fastened in the recess 33. This situation is illustrated in FIG. 4.

Figure 5:
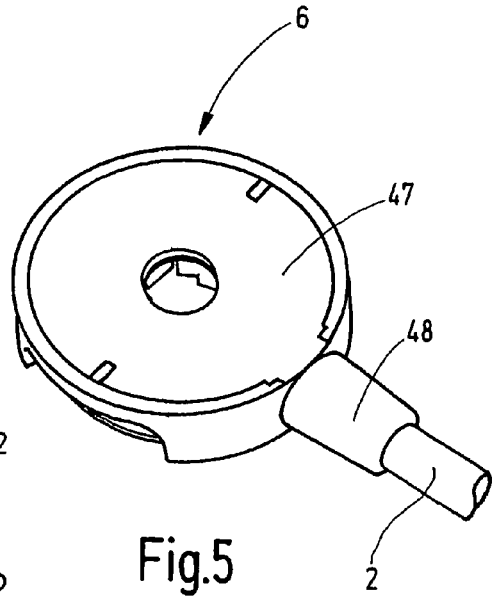
FIG. 5 is a perspective view of the flexible wall on the bottom of the device of FIG. 1.

The housing body 6, with the contact member 3 inserted, is then introduced into the injection mold of a plastic molding machine for the purpose of molding or injecting an elastoplastic wall 47 on or in the surface of the device 1 associated with the electrode 24 with which contact is to be made. To provide additional protection from mechanical stress, the flexible socket 48 is simultaneously or subsequently molded onto the connecting line 2 or the housing body 6. The wall 47 preferably is made of a thermoplastic elastomer of sufficiently low hardness to ensure snug fitting to the shape of the electrode 44. The situation thereby reached is illustrated in FIG. 5.

The two actuating elements 8, 9 are then introduced into the housing body 6, and the drive element 18 is inserted from above. Rotation of the drive element 18 may be effected either by flanged guide surfaces 49 formed by the housing body 6 and in particular by the recess 33. The guide surfaces function in conjunction with the corresponding circumferential surfaces of the drive journal 28, or by the circular guide opening 50 provided on the upper side of the housing body 6, which opening functions in conjunction with the circumferential shape of the drive cover 29.

Figure 6:
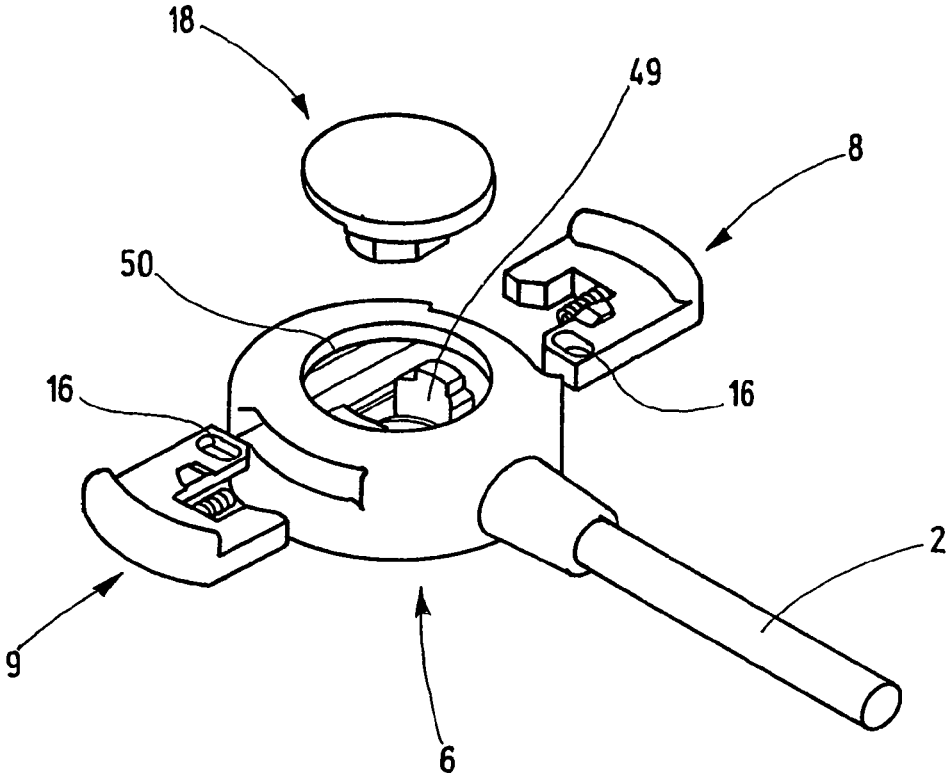
FIG. 6 is a perspective view of the last steps of assembly of the device of FIG. 1.
Figure 7:
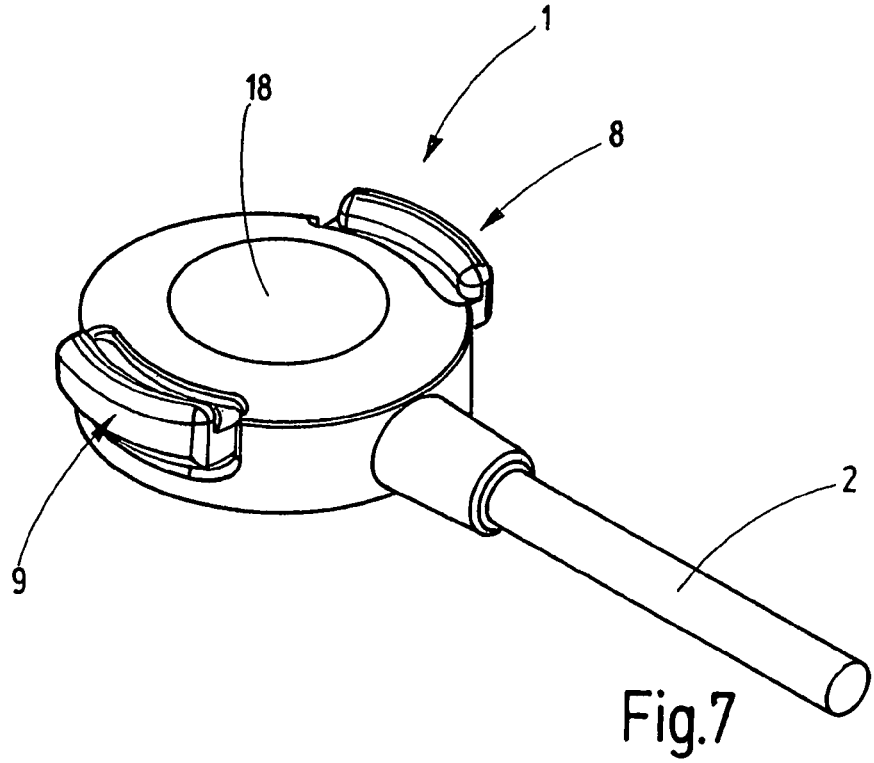
FIG. 7 is a perspective view of the device of FIG. 1 assembled and ready for operation.

When the drive element 18 is introduced, the pins 19 of the drive cover 29 are engaged in the slots 16 of the two actuating elements 8, 9. As a result, the actuating elements are mounted in the housing body 6 so as to be movable or captive. FIG. 6 illustrates the last steps of assembly, while FIG. 7 shows the device 1 of the present invention completely assembled and ready for operation.

While one embodiment has been chosen to illustrate the invention, it will be understood by those skilled in the art that various changes and modifications can be made therein without departing from the scope of the invention as defined in the appended claims.

What is claimed is:

1. A device for electrically connecting a connecting line to an electrode, comprising:

a housing;

a contact member mounted in said housing for connection to a contact pin of an electrode, said contact member having a first energy storage element for spring biasing said contact member to engage the contact pin;

first and second actuating elements movably mounted in said housing to deflect and move said contact member to an open position to receive the contact pin;

a drive element rotatably mounted in said housing, said actuating elements being eccentrically connected on side drive element.

2. A device according to claim 1 wherein the electrode is a medical skin electrode.

3. A device according to claim 1 wherein said drive element comprises an eccentrically extending contact surface, such that when said drive element is rotated said contact member is moved to said open position.

4. A device according to claim 3 wherein said drive element and said actuating element are eccentrically connected to one another by pins on one of said drive element and said actuating elements being received in slots in the other of said drive element and said actuating elements.

5. A device according to claim 1 wherein said drive element and said actuating elements have interacting stopping means for limiting displacement of said actuating elements.

6. A device according to claim 1 wherein said contact member has a second energy storing element for spring biasing said contact member to engage the contact pin and being movable to an open position by said actuating elements.

7. A device according to claim 1 wherein said housing has a top with a rounded shape.

8. A device according to claim 1 wherein said housing comprises a surface facing the electrode to be engaged, said surface having an elastoplastic wall having a hardness less than hardnesses of other walls of said housing.

9. A device according to claim 8 wherein said elastoplastic wall is made from a thermoplastic elastomer.

10. A device for electrically connecting a line to an electrode, comprising a housing having a bore extending along a longitudinal axis of the housing and having a first lateral opening extending substantially perpendicular to said longitudinal axis and being connected therewith;

a driving element rotatably mounted in said bore and having a cam at an inner end thereof and eccentric to said longitudinal axis;

a contact member engaged by said cam, mounted in said housing and extending across a portion of said bore substantially perpendicular to said longitudinal axis, said contact member being spring biased toward a closed position in a direction of said longitudinal axis and being moveable to an open position away from said longitudinal axis by rotation of said cam; and a first actuating element movable translationally in directions substantially perpendicular to said longitudinal axis in said first lateral opening and eccentrically coupled to said driving element to rotate said driving element as said first actuating element moves toward and away from said longitudinal axis.

11. A device according to claim 10 wherein the electrode is a medical skin electrode.

12. A device according to claim 10 wherein said drive element and said actuating element are eccentrically connected to one another by a pin on one of said drive element and said actuating element being received in a slot in the other of said drive element and said actuating element.

13. A device according to claim 10 wherein said drive element and said actuating element have interacting means for limiting displacement of said actuating element.

14. A device according to claim 10 wherein a second contact member engaged by said cam, is mounted in said housing, extends across at portion of said bore substantially perpendicular to said longitudinal axis, is spring biased toward a closed position in a direction of the longitudinal axis, and is movable to an open position away from said longitudinal axis by rotation of said cam; and a second actuating element is mounted a second lateral opening in said housing, is movable translationally and substantially perpendicular to said longitudinal axis and is eccentrically coupled to said driving element.

15. A device according to claim 10 wherein said housing a top with a rounded shape.

16. A device according to claim 10 wherein said housing comprises a surface facing the electrode to be engaged, said surface having an elastoplastic wall having a hardness less than hardnesses of other walls of said housing.

17. A device according to claim 16 wherein said elastoplastic wall is made from a thermoplastic elastomer.

18. A device for electrically connecting a line to an electrode, comprising:

a housing;

a contact member mounted in said housing for connection to a contact pin of an electrode, said contact member having first energy storage element for spring biasing said contact member to engage the contact pin;

a first actuating element mounted in said housing to deflect and move said contact member to an open position to receive the contact pin; and a drive element rotatably mounted in said housing, said drive element and said actuating element being eccentrically connected to one another by a pin on one of said drive element and said actuating element being received in a slot in the other of said drive element and said actuating element.

19. A device according to claim 18 wherein said drive element comprises an eccentrically extending contact surface, such that when said drive element is rotated said contact member is moved to said open position.

20. A device according to claim 18 wherein said drive element and said actuating element have interacting stopping means for limiting displacement of said actuating element.

* * * * *